US008192377B2

(12) United States Patent
Ripperger, III

(10) Patent No.: US 8,192,377 B2
(45) Date of Patent: Jun. 5, 2012

(54) PHYSICAL THERAPY DEVICE

(76) Inventor: Frank J Ripperger, III, Kent, CT (US)

( * ) Notice: Subject to any disclaimer, the term of this patent is extended or adjusted under 35 U.S.C. 154(b) by 1439 days.

(21) Appl. No.: 11/689,560

(22) Filed: Mar. 22, 2007

(65) Prior Publication Data

US 2007/0249972 A1 Oct. 25, 2007

Related U.S. Application Data

(60) Provisional application No. 60/794,493, filed on Apr. 25, 2006.

(51) Int. Cl.
*A61H 1/00* (2006.01)
*A61H 1/02* (2006.01)
*A61H 5/00* (2006.01)

(52) U.S. Cl. ..... 601/5; 601/34; 482/907

(58) Field of Classification Search ..... 482/44–50, 482/79–80, 91, 907; 601/5, 23–24, 27, 32–35; 602/4–5, 23; 128/845, 869, 882; *A61H 1/00, A61H 1/02, 5/00*

See application file for complete search history.

(56) References Cited

U.S. PATENT DOCUMENTS 661,812 A * 11/1900 McKown ..... 602/39
2,369,544 A * 2/1945 Dolan ..... 601/118
4,229,001 A 10/1980 Roman
4,844,454 A 7/1989 Rogers
5,025,802 A * 6/1991 Laico et al. ..... 128/882
5,324,245 A 6/1994 Fontana et al.
5,328,434 A * 7/1994 Carroll ..... 482/140
5,647,823 A 7/1997 Spence
6,416,448 B1 7/2002 Hassler
6,689,028 B2 2/2004 Smith
6,962,570 B2 * 11/2005 Callanan et al. ..... 601/5
7,244,238 B2 * 7/2007 March et al. ..... 601/33
7,534,213 B2 * 5/2009 Shelbourne et al. ..... 601/5
7,762,963 B2 * 7/2010 Ewing ..... 601/5
7,905,816 B1 * 3/2011 Murphy ..... 482/49
2002/0103060 A1 * 8/2002 Webber ..... 482/130
2003/0209248 A1 * 11/2003 Berger et al. ..... 128/845
2004/0049139 A1 * 3/2004 Craciunescu ..... 602/13
2004/0209751 A1 * 10/2004 Thonn, Jr. ..... 482/140

OTHER PUBLICATIONS definition of "about", http://dictionary.reference.com/browse/about.*
definition of "block", http://dictionary.reference.com/browse/block.*

* cited by examiner

*Primary Examiner* — Oren Ginsberg

(57) ABSTRACT

Disclosed herein is a device for supporting a human limb during the application of physical therapy to the limb, the device comprising a base, the base defining a base plane; a support member comprising an attachment end separated from a limb support end by a support distance, wherein the attachment end is movably engaged with the base such that the support member is moveable in a plane of motion essentially perpendicular to the base plane; and wherein the limb support end is conformable to a human limb and capable of supporting the human limb when physical therapy is being applied to the human limb. A method of stretching a human knee using the instant device is also disclosed.

2 Claims, 6 Drawing Sheets

PHYSICAL THERAPY DEVICE

RELATED APPLICATIONS

This application has a priority based on previously filed U.S. Provisional Application Ser. No. 60/794,493 filed Apr. 25, 2006, which is incorporated herein by reference.

FIELD OF INVENTION

The present invention relates to a device and method for supporting a human limb during the application of physical therapy to the limb. In particular, a device and method of stretching a human knee joint using a device. More particularly, the present invention relates to a portable ergonomic leverage device which helps maximize range of motion of the knee joint while maintaining patient comfort and ease of use.

BACKGROUND OF THE INVENTION

The human knee joint is prone to produce scar tissue after operation on the joint. The stretching of scar and muscle tissue in the human knee joint after post operative knee surgery and/or total knee replacement is often necessary. A common problem with total knee replacements or any surgical procedure involving the knee is the formation of post operative scar tissue. Scar tissue is the body's natural healing response to surgical trauma. Unfortunately scar tissue can inhibit a person from regaining full range of motion in the involved area or joint.

Methods of stretching a knee in a physical therapy setting include bending of the knee while the patient is seated with both legs hanging over the edge of the table and/or while the patient is lying prone (on his stomach).

However, while the patient is seated, the pressure put on the leg to stretch the knee into flexion may result in the patient unconsciously lifting their buttocks off the table as a response to the pain or discomfort from the stretch. This approach thus creates a false sense of increased range of motion due to the hips being lifted off the table. As such, the angle of the knee does not appreciably change giving a reduced benefit to the patient. In addition, the patient's heel and calf may hit or be inhibited by the understructure of the table thus preventing any further progression of the range of motion of the joint. When a patient is in the prone position, the quadriceps muscles are stretched instead of the areas within the knee that need the stretching, which areas include those directly over the knee joint. Accordingly, the traditional methods of stretching a knee joint can retard the progression of range of motion and may therefore limit the effect of treatment and may inhibit a successful outcome.

Devices known in the art include those directed to an approach wherein the patient is relied upon to do the stretching. It has been shown that this method of self stretching is much less effective than having another person, preferably a therapist; apply the stretch for the patient. In addition, known devices are bulky and not space efficient thus limiting their usefulness.

U.S. Pat. No. 6,689,028 to Smith ("Smith") is generally directed towards a medical appliance for assisting in the performance of exercises for regaining lost range of motion in a previously traumatized knee joint of the leg of a patient having a planar leg support with a first end and a second end, the leg support further having a cushion attached on the first end thereof, the cushion surrounding the first end of the planar support and being further adapted for fitment adjacent to and behind the knee joint to support and locate the lower leg for performance of exercises, and an elongate stretcher removably attachable to the to the leg support whereby the patient may apply force to the to the stretcher increasing the range of movement in the previously traumatized knee.

However, Smith and others in the art fail to disclose a device which is height adjustable and/or which provide support for the limb to which physical therapy is being applied. In addition, in view of the delicate nature of the posterior human knee, the designs of devices known in the art are far too rigid and non-conforming to provide adequate comfort to the patient, thus limiting their usefulness. This failure in the art to recognize the need for providing support and comfort may result in longer stretch times which may be unsafe do to potential nerve irritation and circulatory deprivation.

Other references generally directed to exercise and stretching of the knee include U.S. Pat. Nos. 4,229,001; 4,844,454; 5,026,049; 5,324,245; 5,647,823; and 6,416,448.

What is needed in the art is a method and device wherein the quadriceps get stretched as well as the knee joint were the scar tissue is most prevalent. After the scar tissue has been relieved through vigorous stretching, the knee joint can function in a more physiologically functional manner.

SUMMARY OF THE INVENTION

In one aspect of the present invention a device for supporting a human limb during the application of physical therapy to the limb, the device comprises:

a base, the base defining a base plane;

a support member comprising an attachment end separated from a limb support end by a support distance, wherein the attachment end is movably engaged with the base such that the support member is moveable in a plane of motion within the base plane, preferably essentially perpendicular to the base plane; and wherein the limb support end is conformable to a human limb and capable of supporting the human limb when physical therapy is being applied to the human limb.

In another aspect of the present invention, a device for supporting a human limb during the application of physical therapy to the limb, the device comprises:

a base, the base defining a base plane;

a support member comprising an attachment end separated from a limb support end by a support distance, wherein the attachment end is movably engaged with the limb support end such that the support distance is variable, and wherein the attachment end can be releasably engaged with the attachment end to fix the support distance;

wherein the support member is attached to the base through a pivot block, the pivot block comprising a pivot pin oriented essentially perpendicular to the plane of motion;

wherein the pivot pin is disposed through an opening in the attachment end of the support member such that the support member is rotationally engaged with the base about the pivot pin;

wherein the support member is movable in a plane of motion essentially perpendicular to the base plane;

wherein the limb support end comprises a yoke having at least two yoke ends separated from each other by a yoke distance along a yoke axis, wherein the yoke axis is oriented essentially perpendicular to the plane of motion, wherein the yoke distance is dimensioned and arranged to support the human limb between the yoke ends when physical therapy is being applied to the human limb.

In still another aspect of the present invention, a method of stretching a human knee comprises the steps of positioning a patient limb such that the popliteal fossa of the knee is supported by the limb support end of the inventive device; and applying pressure to the patent limb to stretch the knee into flexion about the limb support end to provide an amount of distraction to the knee.

In yet another aspect of the present invention, a method of stretching a human knee comprises the steps of positioning a patient limb such that the popliteal fossa of the knee is supported by the limb support end of the inventive device;

moving the support end relative to the attachment end thereby adjusting the support distance to fit the device to the patient limb; and applying pressure to the patent limb to stretch the knee into flexion about the limb support end to provide an amount of distraction to the knee.

These and other features, aspects and advantages of the present invention will become better understood with reference to the following drawings, description and claims.

DETAILED DESCRIPTION OF THE INVENTION

Figure 1:
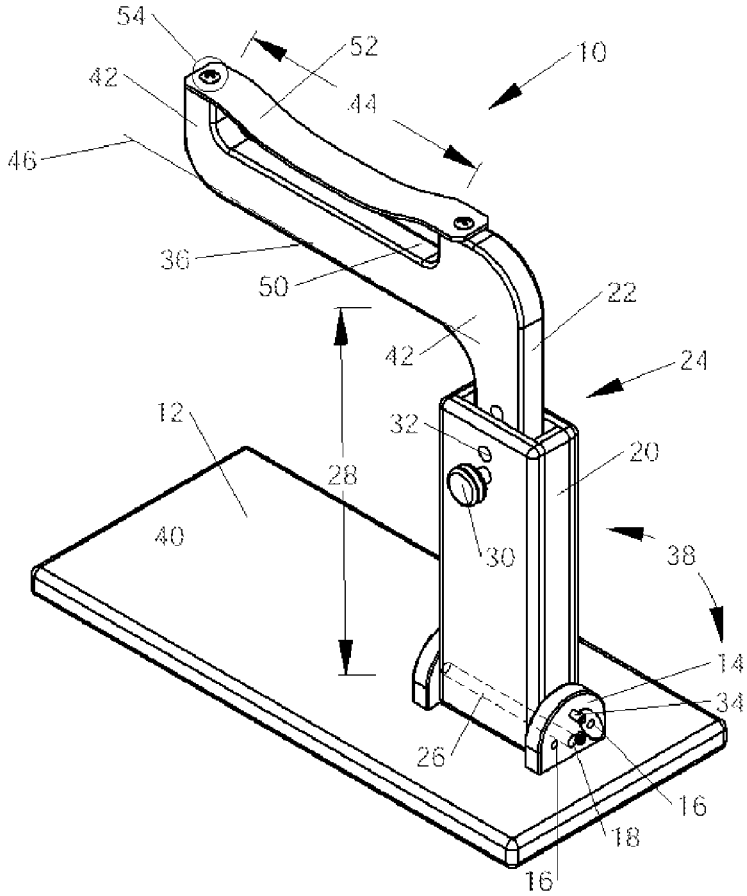
FIG. 1 is a perspective view of an embodiment of the instant device.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention generally provides a portable knee stretching device used for physical therapy of the knee. The embodiment provides an ergonomic mechanical advantage for the physical therapist, while also providing comfort to the patient. With the patient lying in the supine position, the device is placed directly in the crease of the knee otherwise known as the popliteal fossa. The knee is resting on a foam pad which is attached to the sling. The device is then evaluated for proper height to insure not only maximum comfort but optimal leverage. At this point the therapist will either leave the height alone or raise or lower the support arm to get the best fit. Once it is fitted to the patient, the pin can be released to allow the body to move freely with the natural movement of the knee. Now the patient is ready for stretching, which can be provided by gravity, ankle weights or done manually by the therapist. As the knee is being stretched into flexion over the padded sling, the knee has a slight comfortable amount of distraction from being bent over a fulcrum, which directly stretches the scar tissue. At this point the therapist can also stand at the foot of the table and with one hand apply pressure for stretching and the other hand free to provide soft tissue mobilization of the scar. After the therapist is done flexing the knee, it is an option to lock the body in an upright position and place the device at the heel or ankle to get an extension stretch. At this point the patient can do additional exercise to reduce edema while getting an extension stretch.

Like numbers refer to like elements throughout. The word "about" and "approximately" as used herein may be applied to modify any quantitative representation that could permissibly vary without resulting in a change in the basic function to which it is related.

In an embodiment, the instant device for supporting a human limb during the application of physical therapy to the limb, the device comprises a base, the base defining a base plane; a support member comprising an attachment end separated from a limb support end by a support distance, wherein the attachment end is movably engaged with the base such that the support member is moveable in a plane of motion within the base plane. In an embodiment, the support member is movable in a plane of motion essentially perpendicular to the base plane. In addition, wherein the limb support end is conformable to a human limb and capable of supporting the human limb when physical therapy is being applied to the human limb. In an embodiment, the support member is attached to the base through a pivot block, the pivot block comprising a pivot pin oriented essentially perpendicular to the plane of motion, wherein the pivot pin is disposed through a pin opening in the attachment end of the support member such that the support member is rotationally engaged with the base about the pivot pin. In an embodiment, the support member can be fixed to remain at a position within the plane of motion.

Referring to the drawings, FIG. 1 is a perspective view of an embodiment of the instant device useful for the therapeutic stretching of a human limb, preferably a human knee joint. In an embodiment, the instant device, generally referred to as 10 comprises a base 12 in communication with a support member 24. Support member 24 comprises an attachment end 20 in communication with a limb supporting end 22. The attachment end 20 is separated from the limb supporting end 22 by a support distance 28. Attachment end 20 is movably engaged with base 12 such that support member 24 is moveable in a plane of motion 38 within a base plane 40, preferably plane of motion 38 is essentially perpendicular to base plane 40. In an embodiment, base 12 provides a stable plane.

Preferably, base 12 has a rectangular or square shape. Mounted on base 12 is a pivot block 14. Pivot block 14 may further include one or more lock holes 16. Support member 24 can be locked into variable positions using one or more base lock pins 34 disposed through lock holes 16 which engage corresponding slots, holes or depressions (not shown) in the attachment end 20 of support member 24. Pivot block 14 may be attached to base 12 via a plurality of threaded members (e.g., screws), by rivets, welded, or the like. In an embodiment, the pivot block may be located proximate to an outside edge of base 12, preferably about ½-1½ inches away from the edge with ¾-1 inch being preferable. Pivot block 14 comprises pivot pin 18. Pivot pin 18 preferably spans between the elements of pivot block 14 and is mounted through a pin opening 26 disposed through the attachment end 20 of the support member 24. Preferably, pivot pin 18 engages pin opening 26 of attachment end 20 of support member 24 such that support member 24 is rotationally engaged with base 12 about pivot pin 18.

Figure 2:
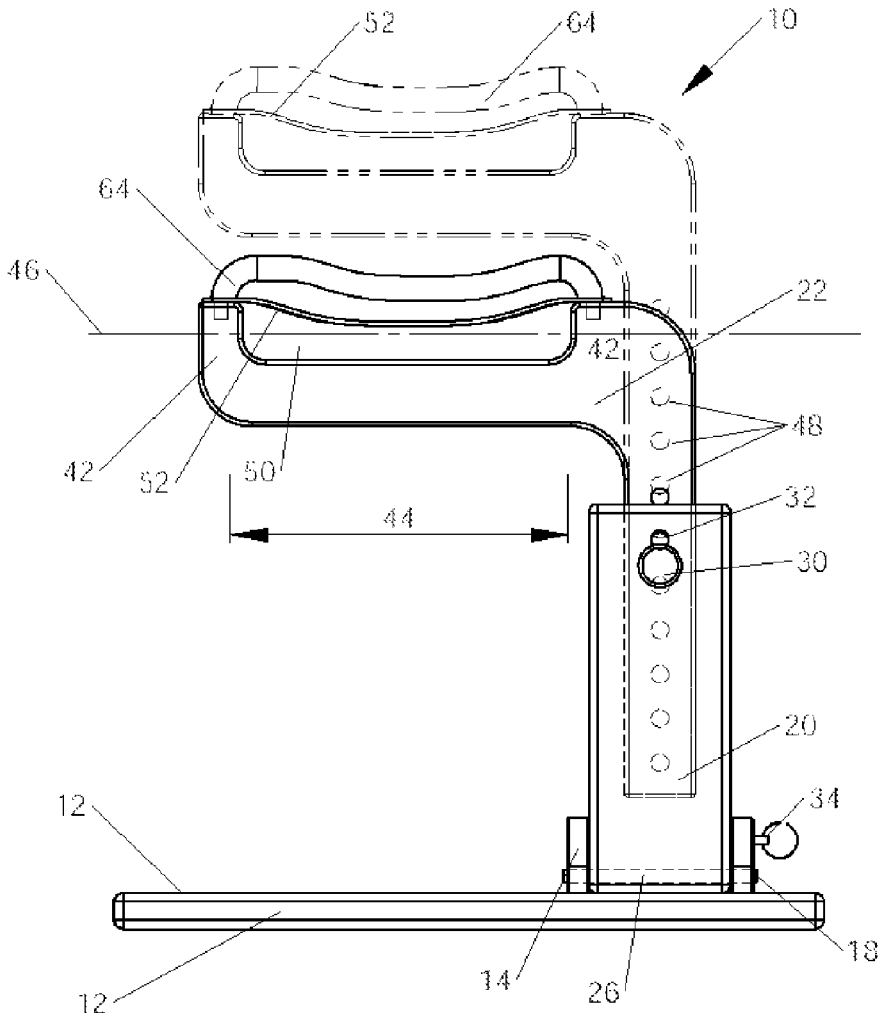
FIG. 2 is a frontal view of an embodiment of the instant device.

In an embodiment, attachment end 20 of support member 24 is hollow and thus slidingly and/or telescopingly engages limb support end 22. In an embodiment, attachment end 20 is movably engaged with limb support end 22 such that support distance 28 is variable. Preferably, attachment end 20 can be releasably engaged with limb support end 22 to fix support distance 28. As shown in FIG. 2, in an embodiment, attachment end 20 is releasably engaged with limb support end 22 using a lock pin 30 disposed through corresponding lock ping lock pin holes 32 through attachment end 20 and support lock pin holes 48 through limb support end 22.

In an embodiment, attachment end 20 comprises a hollow member approximately 4-5 inches (5") wide, 11-12 inches tall and 2-2½ inches thick with at least one, preferably at least 2 lock pin holes 32, front and back dimensioned and arranged to fit with lock pin 32. At least one, preferably a plurality of support lock pin holes 48 are also disposed through limb support end 22. Accordingly, the support distance 28 may be varied and/or adjusted to the exact height of the knee.

Attachment end 20 may have an approximate opening of about 1" wide by 2" long by 16" high, and is dimensioned to receive limb support end 22.

Limb support end 22 may further include a yoke, 36, preferably in the form of an upside down L shape. In an embodiment, limb support end 22 comprises a yoke 36 having at least two yoke ends 42 separated from each other by a yoke distance 44 along a yoke axis 46. Yoke axis 46 is oriented essentially perpendicular to plane of motion 38. Preferably, yoke distance 44 is dimensioned and arranged to support the human limb between yoke ends 42 when physical therapy is being applied to the human limb (not shown).

In an embodiment, yoke 36 comprises an elongated upward C shape forming a trough 50 between the yoke ends 42. In an embodiment, the yoke ends 42 extend about 1 to 2 inches in height and yoke distance 44 is about 6 to about 20 inches in length.

In an embodiment, limb support end 22 comprises at least one flexible support element 52 conformable to the human limb when physical therapy is being applied to the human limb.

In an embodiment, flexible support element 52 comprises at least one flexible sling attached between yoke ends 42, preferably the flexible support element 52 is movably attached via a cleat 54 to at least one yoke end 42 such that the flexible support element 52 e.g., a sling, a chord, or the like, has a variable tension. In an embodiment, flexible support element 52 comprises a conformable pad 64 (see FIG. 2) dimensioned and arranged to contact the human limb when physical therapy is being applied to the human limb. Preferably, conformable pad 64 comprises a chord, a polymeric element, a foam element, a cloth element, an animal fur element, a plush element, or a combination thereof.

Figure 6:
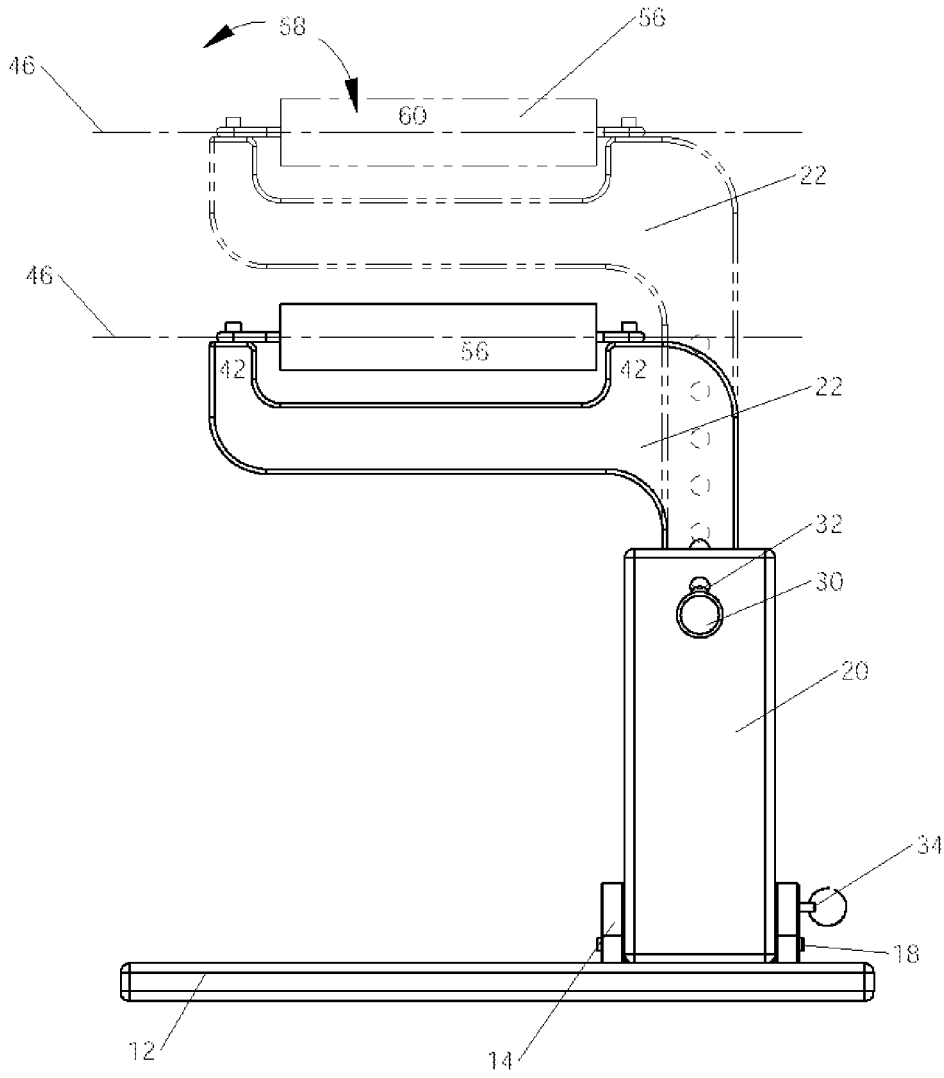
FIG. 6 is a perspective view of an embodiment of the instant device.

As shown in FIG. 6, limb support end 22 may comprises a cylindrical support element 56 attached to support end 22 between yoke ends 42. Preferably, cylindrical support 56 is arranged coaxial to yoke axis 46. In an embodiment, cylindrical support 56 is rotationally attached between yoke ends 42 about yoke axis 46 such that cylindrical support 56 is rotatable 58 about yoke axis 46.

Cylindrical support 56 preferably comprises a cylindrical conformable pad 60 dimensioned and arranged to contact the human limb (not shown) when physical therapy is being applied to the human limb, Cylindrical conformable pad 60 may comprise a chord, a polymeric element, a foam element, a cloth element, an animal fur element, a plush element, or a combination thereof.

Accordingly, flexible support element 52 may be suspended like a hammock, and may comprises either rigid and/or a pliable material, which may be round, flat, or any combination thereof. Flexible support element 52 may be attached to yoke ends 42 in any number of ways.

FIG. 2 is a front view of an embodiment of the instant device, and shows the relationship between attachment end 20 and limb supporting end 22 of support member 24.

Figure 3:
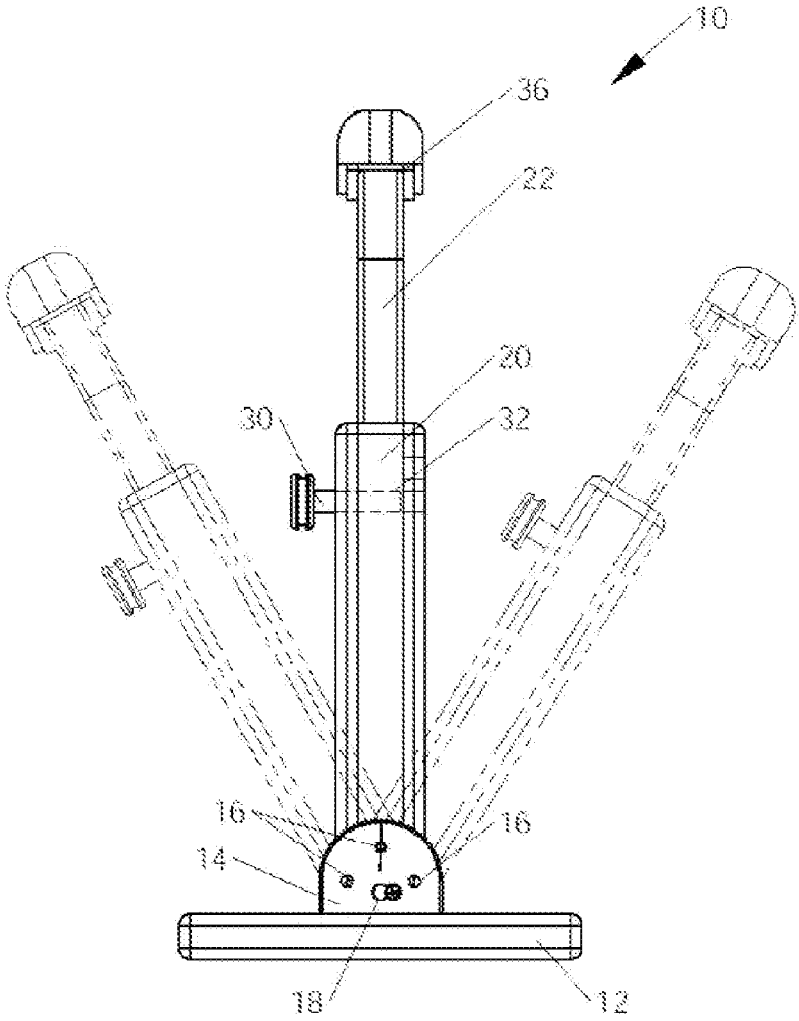
FIG. 3 is a side view of an embodiment of the instant device.

FIG. 3 is a side view of an embodiment of the instant device along yoke axis 46, perpendicular to the plane of motion 38, which provides a detailed view of the action of support element 24 when base lock pin 34 is removed. Accordingly, when base lock pin 34 does not engage attachment end 20, support member 24 is free to move from side to side (in plane of motion 38) while pivoting on pivot pin 18.

In an embodiment, limb support end 22 may further comprise a goniometer 62, which may be used to determine the range of motion of a limb undergoing physical therapy (not shown.)

Figure 4:
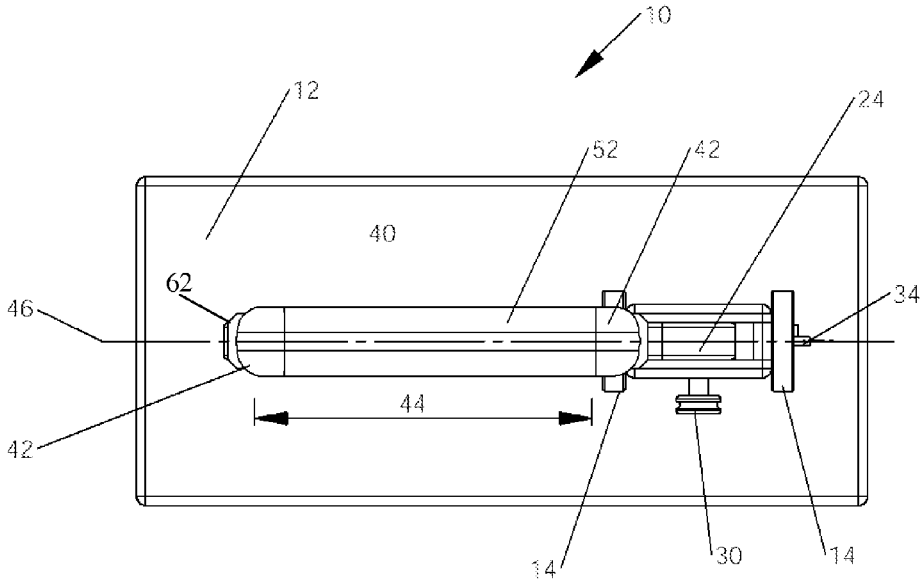
FIG. 4 is a top view of an embodiment of the instant device.

FIG. 4 is a top view of an embodiment of the instant device 10.

Figure 5:
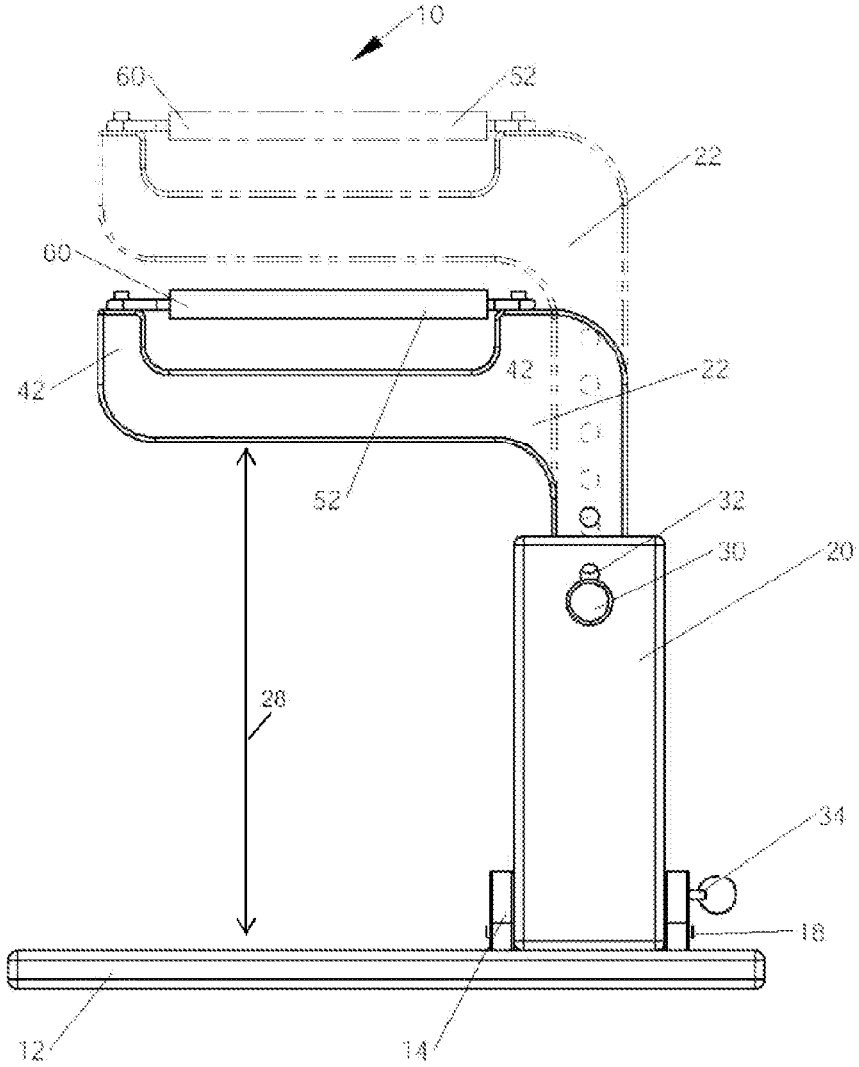
FIG. 5 is a perspective view of an embodiment of the instant device.

FIG. 5 is a front view of an embodiment of the instant device 10.

Accordingly, the instant invention provides:

a knee stretching device for physical therapy of the post surgical knee; the ability of the physical therapist to give proper leverage to stretch the knee into flexion and extension;

the ability to maximize both flexion and extension range of motion while maintaining patient comfort;

the ability to apply the stretch by numerous sources, including gravity, ankle weights and/or manually by the physical therapist;

a portable device for use in a clinic and/or at home, the device having a weight easily managed by persons of all statures, preferably the device weighs under 8 pounds;

a compact portable tool to take into a patients home;

a device which improves physical therapy rehabilitation outcomes;

a device which is ergonomically helpful for both the clinician and the patient;

a device which may free up one of the clinicians hands to allow for scar mobilization or take measurements while continuing to apply a stretch;

a knee stretching device for physical therapy which can be used bilaterally and can be adjusted to fit any size leg;

a device which may elevate the leg to decrease edema/swelling in the knee and ankle; and other benefits and improvements over the art as disclosed herein.

In and embodiment, the instant device may be used in a method of stretching a human knee comprising the steps of positioning a patient limb such that the popliteal fossa of the knee is supported by limb support end 22; and applying pressure to the patent limb to stretch the knee into flexion about the limb support end to provide an amount of distraction to the knee.

The method may further include the step of moving limb support end 22 relative to attachment end 20 thereby adjusting support distance 28 to fit the device to the patient limb. In a preferred method, the patient is in the supine position (not shown.)

I claim:

1. A method of stretching a human knee comprising the steps of:

providing a device for supporting a human knee during the application of physical therapy to stretch the knee into flexion, the device comprising:

a base, the base defining a base plane;

a support member comprising an attachment end separated from a limb support end by a support distance, wherein the attachment end is movably engaged with the base such that the support member is moveable in a plane of motion within the base plane; and wherein the limb support end is conformable to a posterior side of the human knee and capable of supporting the human knee when physical therapy is being applied to the human knee to stretch the human knee into flexion, positioning a patient limb such that the popliteal fossa of the knee is supported by the limb support end of the device; and applying pressure to the patent limb to stretch the knee into flexion about the limb support end to provide an amount of distraction to the knee, wherein the attachment end is movably engaged with the limb support end such that the support distance is variable, and wherein the attachment end can be releasably engaged with the limb support end to fix the support distance;

wherein the support member is attached to the base through a pivot block, the pivot block comprising a pivot pin oriented essentially perpendicular to the plane of motion;

wherein the pivot pin is disposed through an opening in the attachment end of the support member such that the support member is rotationally engaged with the base about the pivot pin;

wherein the support member is movable in a plane of motion essentially perpendicular to the base plane;

wherein the limb support end comprises a yoke having at least two yoke ends separated from each other by a yoke distance along a yoke axis, wherein the yoke axis is oriented essentially perpendicular to the plane of motion, wherein the yoke distance is dimensioned and arranged to support the human knee between the yoke ends when physical therapy is being applied to the human knee to stretch the human knee into flexion.

2. The method of claim 1, wherein a patient is in the supine position.

* * * * *